US009643750B2

(12) United States Patent
Legresy et al.

(10) Patent No.: US 9,643,750 B2
(45) Date of Patent: May 9, 2017

(54) END PANEL, AND A CONTAINER BODY OR CONTAINER PROVIDED BY A DOUBLE SEAM WITH SUCH END PANEL

(71) Applicant: Ardagh MP Group Netherlands B.V., Deventer (NL)

(72) Inventors: Jean-Marc Nicolas Legresy, La Fleche (FR); Philippe Niec, Sable-sur-Sarthe (FR)

(73) Assignee: Ardagh MP Group Netherlands B.V., Deventer (NL)

( * ) Notice: Subject to any disclaimer, the term of this patent is extended or adjusted under 35 U.S.C. 154(b) by 0 days.

(21) Appl. No.: 14/387,357

(22) PCT Filed: Mar. 25, 2013

(86) PCT No.: PCT/EP2013/056200

§ 371 (c)(1),
(2) Date: Sep. 23, 2014

(87) PCT Pub. No.: WO2013/144055

PCT Pub. Date: Oct. 3, 2013

(65) Prior Publication Data

US 2015/0076165 A1 Mar. 19, 2015

(30) Foreign Application Priority Data

Mar. 26, 2012 (EP) ..... 12161332

(51) Int. Cl.

| | |
|---|---|
| ***B65D 6/30*** | (2006.01) |
| ***B21D 51/52*** | (2006.01) |
| ***B21D 51/30*** | (2006.01) |
| *B65D 8/20* | (2006.01) |

(52) U.S. Cl.
CPC ..... *B65D 7/36* (2013.01); *B21D 51/30* (2013.01); *B21D 51/52* (2013.01)

(58) Field of Classification Search
CPC ... B65D 7/36; B65D 7/04; B65D 7/06; B21D 51/52; B21D 51/30
USPC ..... 220/620, 619, 618
See application file for complete search history.

(56) References Cited

U.S. PATENT DOCUMENTS

| | | | | |
|---|---|---|---|---|
| 272,921 | A * | 2/1883 | Tuckett | 220/620 |
| 530,700 | A * | 12/1894 | Malley | 220/619 |
| 853,143 | A * | 5/1907 | Wootten et al. | 220/615 |
| 1,155,751 | A * | 10/1915 | McCue | 220/622 |

(Continued)

FOREIGN PATENT DOCUMENTS

| | | | |
|---|---|---|---|
| FR | 493777 | A * | 8/1919 |
| FR | 493777 | A | 8/1919 |

*Primary Examiner* — J. Gregory Pickett
*Assistant Examiner* — Niki M Eloshway
(74) *Attorney, Agent, or Firm* — The Webb Law Firm

(57) ABSTRACT

The present invention relates to an end panel to be seamed by a double seam to a container body which double seam includes an end hook confined by the container body and a body hook, wherein a panel edge of the end panel forms the end hook and is provided with at least one notch, wherein the panel edge includes at least two adjacent edge parts of which a first edge part has a first radius and a second edge part has a second radius or is a straight edge, and the notch has a width to depth ration of about 10 to 150, and is formed in both adjacent edge parts, to a container body and to a container provided with such end panel.

15 Claims, 3 Drawing Sheets

(56) References Cited

U.S. PATENT DOCUMENTS

| | | | | | |
|---|---|---|---|---|---|
| 1,209,925 | A | * | 12/1916 | Adams | 220/620 |
| 1,446,458 | A | * | 2/1923 | Gerhardt | 220/619 |
| 2,289,193 | A | * | 7/1942 | Henchert | 220/620 |
| 2,455,737 | A | * | 12/1948 | Coyle | 413/6 |
| 3,670,921 | A | * | 6/1972 | Bartels | 220/680 |
| 5,269,602 | A | * | 12/1993 | Kuwahara et al. | 312/406.2 |
| 6,736,284 | B2 | * | 5/2004 | Werth et al. | 220/623 |

* cited by examiner

END PANEL, AND A CONTAINER BODY OR CONTAINER PROVIDED BY A DOUBLE SEAM WITH SUCH END PANEL

CROSS-REFERENCE TO RELATED APPLICATIONS

This application is the United States national phase of International Application No. PCT/EP2013/056200 filed Mar. 25, 2013, and claims priority to European Patent Application No. 12161332.7 filed Mar. 26, 2012, the disclosures of which are hereby incorporated in their entirety by reference.

BACKGROUND OF THE INVENTION

Field of the Invention

The present invention relates to a end panel, and to a container body or container provided by a double seam with such end panel.

Description of Related Art

Containers of the type according to the invention comprise an end panel that is connected to the container body via a double seam. A double seam is formed by first laying a panel edge against a body edge. In a first operation, the panel edge is curled radially outward over the body edge and then upwardly forming a curl and a transition wall of the double seam. Thereafter, the panel edge is urged to move radially inwardly until near or at the container body thereby forming the end hook. The body edge is thereby confined or closed into a panel loop formed by the panel edge, a curl and an adjacent part of the end panel. In a second operation, the panel loop is pushed against the container body whereby the panel edge becomes confined between the body edge and the container body. In the formed double seam the panel edge forms the end hook and the body edge forms the body hook of the double seam.

During the radial inward movement of the panel edge and to some extent also of the body edge the diameter in the curved section thereof will decrease. This decrease in diameter creates compression stresses in tangential directions in the metal material of the edges, that is, a direction along the circumference of the panel edge and the body edge. The compression stresses locally create defects in the metal and ultimately will result in pleats or wrinkles.

This phenomenon will be more pronounced when using thinner metal end panels and container bodies. A possible solution to the wrinkling phenomenon may be the formation of a double seam in which the end hook, and sometimes also the body hook, has a reduced length and thus extent to over a smaller distance into the double seam. Such double seam having a shorter end hook and possibly also a shorter body hook has a higher risk for leakage, particularly when the content of the closed container is (temporarily) pressurized. This internal pressure generates an internal splitting force on the container body and end panel and ultimately could unroll the double seam.

Wrinkling is an inherent problem in relation to double seams because the panel edge mandatorily has to move radially inwardly for forming the panel loop overlaying the body edge. Since the wrinkling problem will be more pronounced with thinner end panels and container bodies, it appears almost impossible to make a reliable double seam with thinner end panels and container bodies unless cost increasing additional measures are taken, such as compressing or pinching the double seam or use a sealing compound.

U.S. Pat. No. 2,455,737 disclosed a rectangular container provided with a rectangular closure. This closure is double seamed to a container body via a panel edge. The panel edge is provided in the curved sections of the panel edge with sharp V-shaped notches. The notches are so deep that the notch is also present in the transition wall between a curl of the panel wall and the end hook. The sharp V-shaped notches are dimensioned such that in the formed double seam the edges of the notch are brought in close contact, the notch is closed up and a continuous wall formed. This construction is intended to avoid leakage.

However, there remains a risk for leakage because the closing cannot be controlled so that the notch may not fully close. In addition, when over-closing the notch the edges do no longer abut, but overlap resulting in a circumferential stress and in an irregular "puckering" deformation interfering with the formation and tightness of the double seam. This is even more true when the notches are formed in a non-circular end panel because with different radii and/or straight edges, the compression stress and/or tensile stress is not substantially constant over the circumference.

In addition, the V-shaped notches have a sharp bottom end. Such sharp V-shape is prone to crack initiation due to stress, when the edge is curved radially outwardly and upwardly during the formation of the curl between the panel wall and the transition wall of the double seam.

SUMMARY OF THE INVENTION

The present invention has for its object to provide a solution to above mentioned problems and makes it feasible to making a reliable double seam while using thinner materials for in particular the end panel of non-circular container bodies and containers. This is accomplished with the present invention with end panel according to the invention which end panel is to be seamed by a double seam to a container body which double seam comprising a end hook confined by the container body and a body hook, wherein a panel edge of the end panel forms the end hook and is provided with at least one notch, wherein the panel edge comprises at least two adjacent edge parts of which a first edge part has a first radius and a second edge part has a second radius or is a straight edge, and the notch has a width to depth ratio of about 10 to 150, and is formed in both adjacent edge parts.

The present invention is based on the insight that wrinkling can be avoided when less or substantially no compression stresses are generated during the inward movement of the metal panel edge when the notch is provided only in the part of the panel edge that is to form the end hook. Accordingly, the notch may be provided in the outer part of the panel edge, but should have a particular width to depth ratio for meeting the localization requirement, and there is no need for fully closing the notch during double seaming and/or a notch extends over a part of the width of the of the panel edge, but still avoid leakage and wrinkling. This notch forms a gap that will reduce in size and becomes compressed laterally thereby neutralizing to a sufficient extent the generated compression stresses. Effectively the notch provides space for the surplus of material superfluous when formed during the radially inward movement. The reduction of compression stress will also result in less or no occurrence of wrinkles. Thus, the invention allows for the making of double seams using materials of lower gauges, that is use thinner materials, without changing the shape and height of the double seam. Obviously, the size and the number of notches will be selected such that substantially the occurrence of compression stresses is avoided for a particular container.

The invention is not only incorporated in double seamed containers comprising compressed notches but also in a panel end and container body of which an edge is provided with at least one notch that will be compressed during the double seaming operation. Accordingly, both aspects of the invention will be described hereafter with first a description of preferred embodiments of the container of the present invention.

During the making of the double seam compression stresses and/or crack forming tensile stress may also occur in the body edge forming the body hook in a double seam. Accordingly, a preferred container according to the invention is characterized in that the body hook is provided with at least one circumferentially notch.

The compression stress is substantially only generated in a section of the double seam where the inward movement results in a reduction of the diameter and thus in a surplus of material, such section is a curved section. Accordingly, the notch is present in the transition between the two different radii or a radius and a straight line. Obviously, one or more notch may be present in the close vicinity (such as within 1-5 mm) of the first notch.

It is beneficial that the neutralization of the compression stresses due to the diameter reduction and the generation of surplus material takes place is compensated at the transition between adjacent edge parts with different radii or between a curved edge part and a straight edge part. Research has shown that sufficient compensation is possible when the notch is present in the transition where there is a difference in the extent of formed additional material due to double seaming.

Preferably, the width to depth ratio is about 20 to 100, and more preferably about 30 to 80. However, the ratio is also dependent on height of the double seam formed and thus of the height of the end hook. Thus, the height of the notch may be restricted and generally varies between about 0.1 to 0.8 mm, and more preferably between about 0.1 and 0.4 mm. The width is selected such as to allow compensation for the additional material formed, generally of about 2 to 20 mm, practically about 5 to 15 mm. When relatively deep notches (such as about 0.3 to 0.6 mm) are present in combination with narrow notches then the ratio may be 10 to 80, such as 30 to 80.

The invention provides optimal results with an end panel, wherein the ratio of the first radius and the second radius is in the range of about 0.05 to 0.5, preferably in the range of about 0.1 to 0.5, and more preferably in the range of 0.1 to 0.3. Thus, relatively differently curved end panels and corresponding container bodies may be used. For example the end panel has an oval shape. An oval shape is a shape wherein the transitions between the two shapes with different radii are the same for all corners. For optimal results according to the invention, notches are formed in each of the transitions between the first (or smaller) radii and the second radii.

The invention may also be used for containers and end panels with a less regular shape and having at least one section with a straight form, such as an end panel having a pear shape. In pear shape container and end panel has at least one transition between a curved section with a radius and a straight section (radius infinite). Accordingly, it is preferred that the end panel comprises transitions between the first radii and the second radii and transitions radii with the straight line and notches are formed in the transitions.

The form of the notch should be such that compression stresses and strains generated result in a lateral compression of the notch thereby forming a compressed notch. Thus, the form of the notch may vary with the thickness of the edge in which the notch is formed, with its location in or near the curved section. Any form that will allow such function is considered to be within the ambit of the invention. Still particular forms may be preferred under specific circumstances. The notch may be an edged notch having sharp or angle transitions between the notch gap and the edge. The notch may be a rounded notch which is generally preferred for a smooth and even double seam formation. When the compression stress is generated at both sides of the notch then it is preferred to use a symmetrical notch. Under other circumstances the notch may also be asymmetrical, that is having a different shape to both of its sides. Preferably, the notch has a curved shape.

Another aspect of the invention relates to a container body connected to an end panel via a double seam which double seam comprising a end hook confined by the container body and a body hook, wherein an panel edge of the end panel forms the end hook, and wherein the end panel is an end panel according to invention. The container body may have in cross section an oval form or a pear shape.

Another aspect of the invention relates to a method of making a container according to the invention. This method produces a container comprising a container body and an end panel, wherein the end wall is seamed to the container body via a double seam comprising a end hook confined by the container body and a body hook. The method is characterized by comprising the steps of:

i) providing a container body:

ii) providing a panel end according to the invention;

iii) double seaming the panel end to the container body such that during at least the radial inward movement of the panel edge the notch is circumferentially compressed due to compression stresses, where after the panel edge is folded onto the container body a panel edge of the end panel forms the end hook and is provide with at least one notch, wherein the panel edge comprises at least two adjacent edge parts of which a first edge part has a first radius and a second edge part has a second radius or is a straight edge, and the notch has a width to depth ratio of about 10 to 150, and is formed in both adjacent edge parts.

BRIEF DESCRIPTION OF THE DRAWINGS

Mentioned and other features of the present invention will be further described, discussed and illustrated in the following description of several embodiments of the present invention without the intention to restrict the invention to these embodiments. In this respect reference will be made to the annex drawings wherein.

DESCRIPTION OF THE INVENTION

Figure 1:
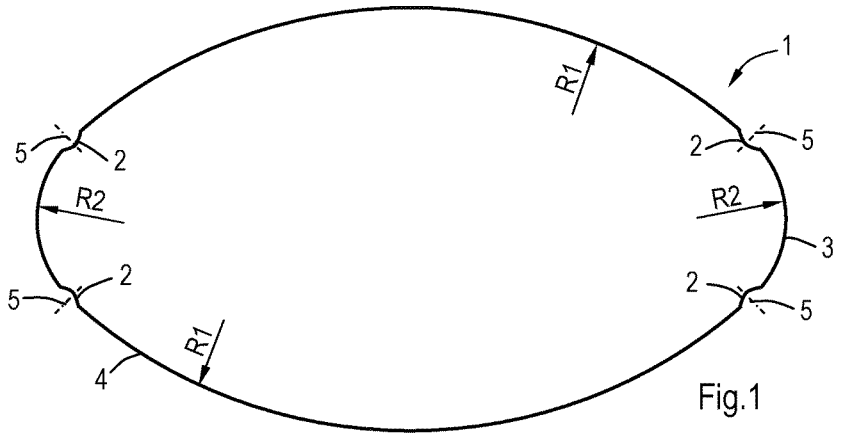
FIG. 1-3 are non-circular end panels according to the invention having notches in the transition between differently curved sections or between a curved and a straight section.

FIG. 1 shows an oval end panel 1 of the invention. The end panel 1 is provided with notches 2 in the adjacent curved edge parts 3 and 4. The radius R1 (45 mm) of the curved part 3 is different and larger than the radius R2 (20 mm) of the curved part 4. The notches overlap with the transition 5 between the radii R1 and R2.

Figure 2:
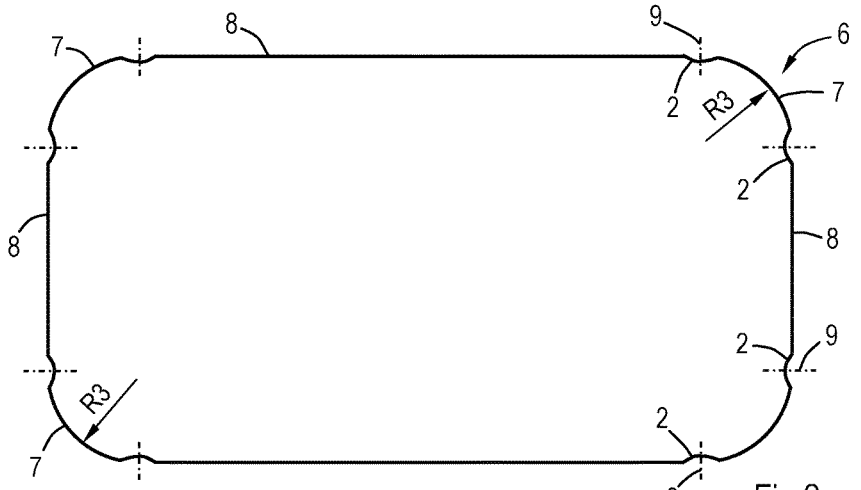

FIG. 2 shows a rectangular end panel 6 of the invention. The rectangular end panel 6 is provided with notches 2 in adjacent curved edge part 7 and the straight edge part 8. The radius R3 of the curved part 7 is for instance 20 mm. The notches 2 overlap with the transition 9 between the curves edge parts 7 and the straight edge parts 8.

Figure 3:
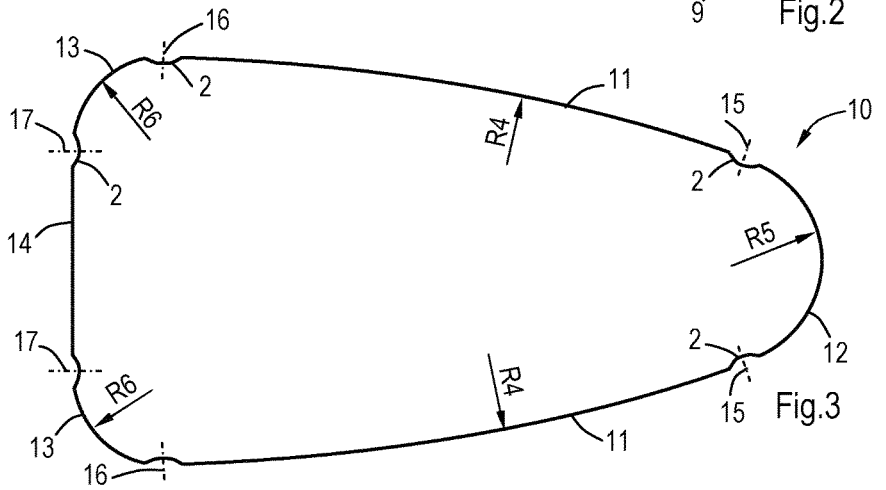

FIG. 3 shows a pear shape end panel 10 of the invention. The pear shaped end panel 10 is provided with notches 2 in the adjacent curved parts 11 and 12, and between the curved parts 11 and the straight edge part 14. The radius R4 (ranging from 150 mm to 190 mm) of the curved part 11 is different and larger than the radius R5 (ranging from 30 mm to 50 mm) of the curved part 12. The notches overlap with the transition 15 between the radii R4 and R5. The notches 2 are also present in the adjacent curved edge part 11 and the straight edge part 14. The radius R4 of the curved parts 11 is for instance (170 mm). The notches 2 overlap with the transition 17 between the curves edge part 13 and the straight edge parts 14 and with the transition 16 between the curved sections 11 and 13. The radius R4 (170 mm) of the curved part 11 is different and larger than the radius R6 (30 mm) of the curved part 13.

Figures 4A, 4B:
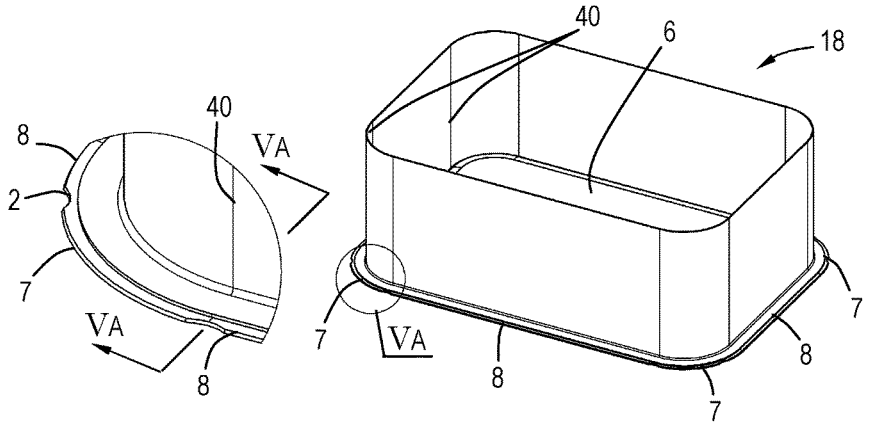
FIG. 4A is a perspective view of a rectangular contained body to be provided with an end panel of the invention.
FIG. 4B is a droplet magnification from FIG. 4A.
Figures 5A, 5B, 5C:
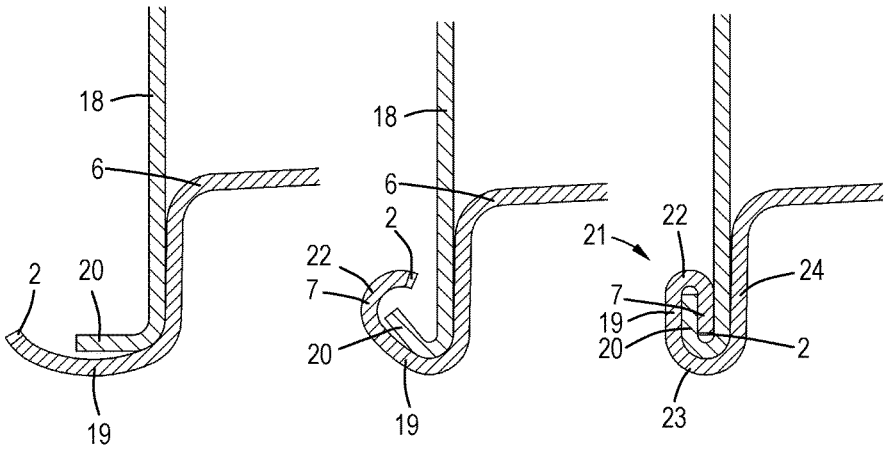
FIGS. 5A -5C are cross sections over the line VA-VA in FIG. 4B of the double seaming method.

FIG. 4A and 4B show the double seaming of the rectangular panel 6 to a rectangular container body 18. The container body 18 is placed into the panel 6 of which the curved panel edge 19 extends outwardly from the container body edge 20 (see FIG. 5A). The panel edge 19 is further curved and bended inwardly thereby comprising the curved edge part 7 and the straight edge part 8 (not shown) and also the notch 2 (see FIG. 5B). Subsequently, the panel edge 19 is curled upwardly thereby forming the double seam 21. FIG. 5D shows the double seam 21, in which the initial panel edge 7 is now overlaying the container body edge 19 which is now confined or closed in by a loop formed by the panel edge 7, the curl and the transitional wall 22. The double seam comprises a so-called end hook formed by the original panel edge 7 comprising the notches 2. The end hook is confined or closed in by the container body 18 and a body hook 10 which is formed by the original container edge 20. At the outside of the double seam 9 is the transition wall 22 connecting the end hook 7 via a curl 23 with a panel wall 24 of the end panel 6.

FIGS. 6A-E shows various embodiments of the notches 2 according to the invention. The notches all have a width W to depth D ratio within the range of about 10 to 150, see FIG. 6F.

Figure 6A:
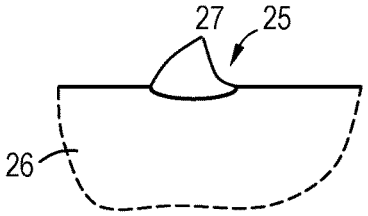
FIGS. 6A-6F show various embodiments of notches according to the invention.
Figure 6D:
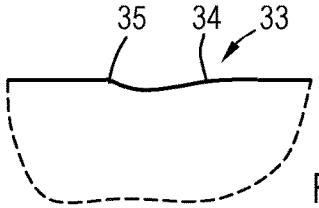

FIG. 6A shows a notch 25 formed in the panel edge 26 and has hooks or angular transitions 27 towards the rim 17 of the panel edge 5. The notch 25 has a W:D ratio of about 30.

Figure 6B:
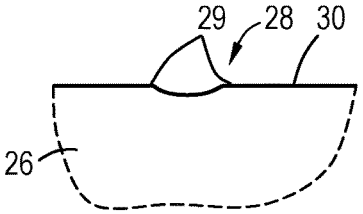
Figure 6E:
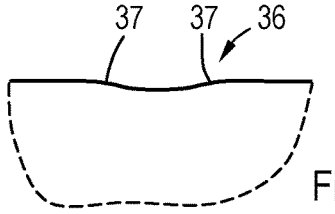

FIG. 6B shows a notch 28 which has transitions 29 which are rounded towards the rim 30. The W:D ratio is about 40.

Figure 6C:
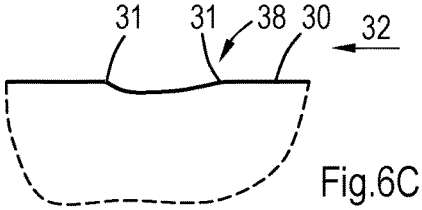
Figure 6F:
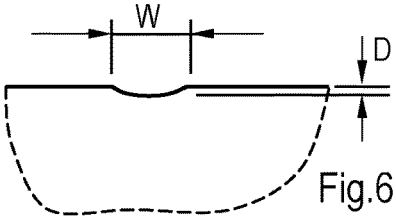

FIG. 6C shows a notch 30 having rounded or curved transitions 31 but has an asymmetrical form. Such asymmetrical form may be beneficial when the double seam operation using a roller tool operates along the rim 30 from the right as shown in FIG. 6C by the arrow 38. But seaming from the reverse direction (left in FIG. 6C) is also possible.

FIG. 6D shows a notch 33 which is having rounded transition 34 at one side and a hooked transition 35 at the left side, whereas the notch 33 is further asymmetrical. The W:D ratio is about 50.

Figure 7B:
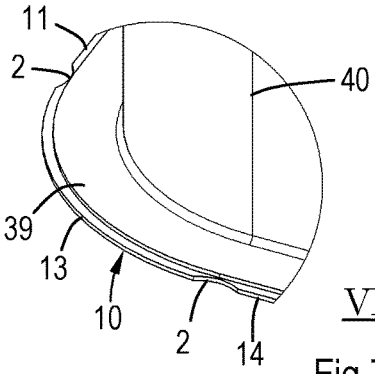
FIGS. 7A and 7B, and 8A and 8B are a perspective view and droplet magnification for a pear shaped and oval shaped container body, respectively of the invention.

FIG. 6E shows a notch 36 which is symmetrical and having rounded transitions 37 but is less steep or has a lower depth than the notch 28 of FIG. 7B, the W:D ratio is about 70.

Figure 7A:
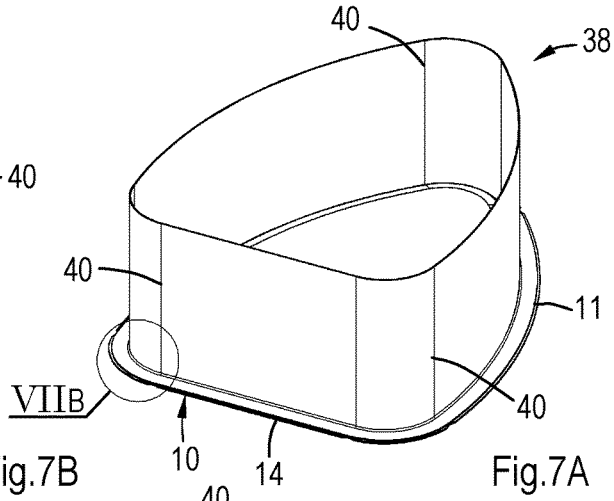

FIGS. 7A and 7B show the pear shaped end panel 10 onto which is placed a container body 38 having a pear shape in cross section. The straight panel edge 14, and the curved edges 13 and 11 are provided at the transitions 40. The panel edges extend beyond the body edge 39. The double seam is formed as discussed in relation to the embodiment illustrated by the FIGS. 5A to 5C.

Figure 8B:
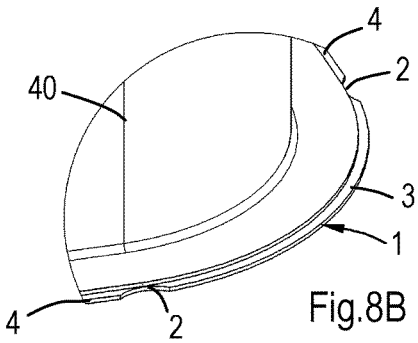
Figure 8A:
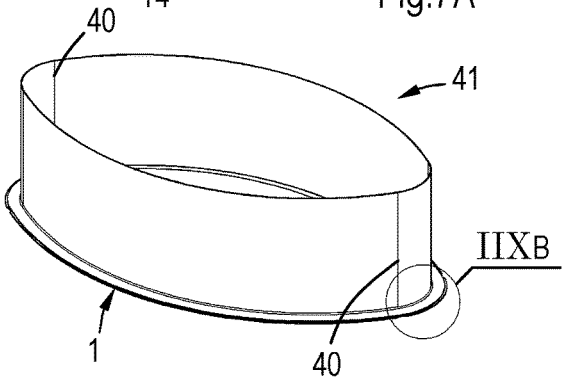

Similarly, show FIGS. 8A and 8B an oval container body 41 placed on the oval end panel 1. At the transitions 40 are the curved edges 3 and 4 provided with a notch 2.

Although not described in detail and in the form of an embodiment, it will be obvious to the skilled person that the curved and straight edges may comprise additional notches in the direct vicinity of the notches 2, such as within a few millimeters there from.

The materials to be used for double seaming according to the method according to the present invention are in particular metals such as steel, coated steel, tin plate and aluminum alloys. Composites of metal and plastics may also be used, such as laminated steel produced by extrusion or co-lamination. Dependent on the diameter of the container produced, the thickness of the steel or tin plate, may be in the range of 0.14 mm to 0.32 mm, and preferably within the range of 0.16 mm to 0.22 mm, inter alia dependent on the can diameter and on the double seam type characterized by a parameter such as the seam length. In case of aluminum alloy, the thickness of the metal for the at least panel edge 5 may be in the range of 0.16 mm to 0.38 mm, preferably 0.18 mm to 0.28 mm, inter alia dependent on the can diameter and on the double seam type, and on the seam length.

Research and experiments have shown that by using the notched panel edges and possibly notched container edges that the gauge of the thickness of the metal to be used may be reduced by at least 10%, with additional seaming geometry modification up to 30%, and preferably up to 20%. Obviously, the thickness of the metal would be also dependent on the diameter of the container.

The invention claimed is:

1. A container body connected to an end panel via a double seam, with the double seam comprising an end hook confined by the container body and a body hook, wherein a panel edge of the end panel comprises a first portion provided with at least one notch and a second portion, wherein the first portion with the at least one notch forms the end hook and the second portion comprises a transition wall connecting the end hook with a panel wall of the end panel such that the at least one notch is only formed in the first portion of the end panel and an entirety of the notch is confined by the container body and the body hook, wherein the panel edge further comprises at least two adjacent edge parts of which a first edge part has a first radius and a second edge part has a second radius or is a straight edge, and the notch has a width to depth ratio of about 10 to 150, and the notch is formed in a transition between the first edge part having the first radius and the second edge part having the second radius or the straight edge such that the notch is formed in both adjacent edge parts.

2. The container body according to claim 1, wherein the width to depth ratio is about 20 to 100.

3. The container body according to claim 1, wherein the ratio of the first radius and the second radius is in the range of about 0.05 to 0.5.

4. The container body according to claim 1, wherein the end panel has an oval shape.

5. The container body according to claim 4, wherein notches are formed in each of the transitions between the first radii and the second radii.

6. The container body according to claim 1, wherein the end panel has a pear shape.

7. The container body according to claim 6, wherein the end panel comprises transitions between the first radii and the second radii and a transition between radii with the straight line, and notches, are formed in the transitions.

8. The container body according to claim 1, wherein the notch has a curved shape.

9. The container body according to claim 1, having in cross section an oval form.

10. The container body according to claim 1, having in cross section a pear shape.

11. A container provided with a container body according to claim 1.

12. The container body according to claim 1, wherein the width to depth ratio is about 30 to 80.

13. The container body according to claim 1, wherein the width to depth ratio is about 10 to 80.

14. The container body according to claim 1, wherein the ratio of the first radius and the second radius is in the range of about 0.1 to 0.5.

15. The container body according to claim 1, wherein the ratio of the first radius and the second radius is in the range of about 0.1 to 0.3.

* * * * *